US007918584B2

(12) United States Patent
Isayama

(10) Patent No.: US 7,918,584 B2
(45) Date of Patent: Apr. 5, 2011

(54) METHOD AND SYSTEM FOR THREE-DIMENSIONALLY STAGING

(75) Inventor: Kiyoshi Isayama, Tokyo (JP)

(73) Assignee: ISA Co., Ltd., Tokyo (JP)

( * ) Notice: Subject to any disclaimer, the term of this patent is extended or adjusted under 35 U.S.C. 154(b) by 431 days.

(21) Appl. No.: 12/078,524

(22) Filed: Apr. 1, 2008

(65) Prior Publication Data

US 2008/0247179 A1 Oct. 9, 2008

(30) Foreign Application Priority Data

Apr. 3, 2007 (JP) ..... 2007-097805

(51) Int. Cl.
*F21S 4/00* (2006.01)
*F21V 21/00* (2006.01)

(52) U.S. Cl. ..... 362/249.03; 362/238; 362/285; 362/384; 362/391; 362/419

(58) Field of Classification Search ..... 362/232–233, 362/238, 249.02–249.03, 249.07–249.11, 362/270, 285–287, 372, 383–384, 386, 391, 362/418–419
See application file for complete search history.

(56) References Cited

FOREIGN PATENT DOCUMENTS

| | | |
|---|---|---|
| DE | 20 57 484 A1 | 5/1972 |
| DE | 91 09 580 U1 | 11/1991 |
| EP | 0 862 082 A1 | 9/1998 |
| FR | 2 643 134 A1 | 8/1990 |
| JP | A-08-148005 | 6/1996 |
| WO | WO 93/03306 | 2/1998 |

*Primary Examiner* — Jason Moon Han
(74) *Attorney, Agent, or Firm* — Oliff & Berridge, PLC

(57) ABSTRACT

A three-dimensional stage representation method and system are disclosed, for moving a plurality of illumination devices up and down independently. The method comprises the steps of: identifying a device to be operated from input containing information on length of a reel wire from an elevator device to an illumination device and brightness of an LED and generating an indication signal to the device to be operated; transmitting the generated indication signal to the elevator device if the device to be operated is the elevator device; operating the reel; transmitting the generated indication signal to the illumination device if the device to be operated is the illumination device; operating the LED; forming a three-dimensional object using all of the LEDs by operating each of the devices; and forming a dynamic three-dimensional object using all of the LEDs by repeating all of the above-mentioned steps.

4 Claims, 10 Drawing Sheets

METHOD AND SYSTEM FOR THREE-DIMENSIONALLY STAGING

This application claims the benefit of Japanese Patent Application No. 2007-097805, filed Apr. 3, 2007 which is incorporated herein by reference in its entirety.

BACKGROUND OF THE INVENTION

1. Field of the Invention

The present invention relates to a method and a system for three-dimensionally staging. More specifically, the present invention relates to a three-dimensional staging method and system, providing a three-dimensional representation in a theater, a concert hall, a TV studio or others by individually moving a plurality of illumination devices up and down.

2. Description of the Related Art

In the past, there has been a stage representation system wherein a plurality of illumination devices for lighting players and a stage setting including large props or stage properties are suspended from a ceiling of a theater, a concert hall, a TV studio or others, and moved up and down. In such a stage representation system as moving the plurality of illumination devices up and down, there is one having an elevation baton suspending the plurality of illumination devices therefrom and capable of moving up and down.

There is a case, however, in that on the way of descending the elevation baton according to the stage representation system described above, one of the plurality of illumination devices suspended from the elevation baton is in contact with a barrier. In such a case, there is a problem if it is necessary for further descending the other illumination devices not in contact with the barrier, in that the latter illumination devices are impossible to be descended.

A stage representation system having an elevation baton free from the above-mentioned drawback is disclosed in Japanese Patent Application Publication Laid-Open No. Hei 8-148005, wherein a movable portion of an elevator device is divided into two sections; a main elevator section movable up and down along a distance up to the vicinity of a floor, and a one-point suspension displacement elevator section for moving an illumination device by a short pole; so that the displacement elevator section is miniaturized, and further the elevator device is arranged by using a planar baton so that the illumination device is two-dimensionally movable by the two-dimensional movement of the planar baton.

When the three-dimensional stage representation is provided by the one-point suspension displacement elevator in a theater, a concert hall or a TV studio, however, there is a problem in that, since a height of the illumination device moved downward by the one-point suspension displacement elevator is fixed, it is impossible to provide the three-dimensional representation wherein the plurality of illumination devices are independently moved up and down.

Also, if the illumination is represented by using the one-point suspension elevator when the three-dimensional representation is provided in a theater, a concert hall or a TV studio, even if the height of the illumination device moved down by the one-point suspension displacement elevator is not fixed, the displacement distance due to the short pole of the one-point suspension displacement elevator is too short to provide the three-dimensional representation for moving the plurality of illumination devices independently from each other.

SUMMARY OF THE INVENTION

An object of the present invention is to provide a three-dimensional stage representation method and system for moving a plurality of illumination devices independently from each other, free from the above-mentioned drawbacks of the prior art.

According to one aspect of the invention, in a stage representation system comprising a control device, a plurality of elevator devices, and a plurality of illumination devices, the control device including a device control means, an input/output means and a transmission/reception means, each of the plurality of elevator devices including an up-down motion control means, a motor and a reel coupled to the motor, each of the plurality of illumination devices including an illumination control means and a light-emitting diode (LED), wherein the number of the elevator devices is the same as the number of the illumination devices and each of the illumination devices is coupled to the corresponding one of the elevator devices by a reel wire, a three-dimensional stage representation method used for performing the three-dimensional is provided. The method comprises the steps of: (a) by the device control means in the control device, identifying a device to be operated from input containing information on length of the reel wire from the elevator device to the illumination device coupled to each other as well as brightness of the LED and generating an indication signal to the device to be operated; (b) if the device to be operated identified by the device control means of the control device is the elevator device, by the transmission/reception means of the control device, transmitting the indication signal generated by the device control means of the control device to the elevator device to be operated; (c) upon the reception of the indication signal transmitted from the transmission/reception means of the control device, by the up-down motion control means of the elevator device, transmitting the content of the received indication signal to the motor of the elevator device to be operated, whereby the motor of the elevator device is operated to move the reel of the elevator device so that the length of the reel wire from the elevator device to the illumination device coupled to each other becomes the input length of the reel wire; (d) if the device to be operated identified by the device control means of the control device is the illumination device, by the transmission/reception means of the control device transmitting the indication signal generated by the device control means of the control device to the illumination device to be operated; (e) upon the reception of the indication signal transmitted from the transmission/reception means of the control device, by the illumination control means of the illumination device, transmitting the content of received indication signal to the LED of the illumination device to be operated, whereby the LED is operated based on the input information in relation to the brightness of the LED; (f) forming a three-dimensional object by using all of the LEDs as a result of performing the steps (c) and (e) on each of the plurality of elevator devices and each of the plurality of illumination devices; and (g) forming a dynamic three-dimensional object by using all of the LEDs as a result of performing the steps (a) to (f) repeatedly.

According to another aspect of the invention, a three-dimensional stage representation system used for performing the three-dimensional stage representation is provided. The system comprises a plurality of elevator devices, each of the plurality of elevator devices including: a motor, a reel coupled to the motor, and an up-down motion control means for driving the motor to operate the reel; a plurality of illumination devices having the same number as the plurality of elevator devices, each of the plurality of illumination devices coupled to the corresponding one of the plurality of elevator devices by a reel wire, and each of the plurality of illumination devices including: a light-emitting diode (LED), and an illumination control means for operating the LED; and a control device including: a device control means for identifying a device to be operated by an input containing information on length of the reel wire from the elevator device to the illumination device coupled to each other as well as brightness of the LED and generating an indication signal to the device to be operated, and a transmission/reception means for transmitting the indication signal generated by the device control means to the device to be operated if the device to be operated identified by the device control means is the elevator device or the illumination device; wherein the up-down motion control means of the elevator device receives the indication signal transmitted from the transmission/reception means of the control device and transmits the content of the received indication signal to the motor to operate the reel so that the length of the reel wire from the elevator device to the illumination device coupled to each other becomes the input length of the reel wire; wherein the illumination control means of the illumination device receives the indication signal transmitted from the transmission/reception means of the control device and transmits the content of the received indication signal to the LED to operate the LED of the illumination device based on the input information in relation to the brightness of the LED; wherein a three-dimensional object is formed using all of the LEDs resulting from operating the motor to operate the reel by the up-down motion control means of the elevator device and operating the LED by the illumination control means of the illumination device, in relation to each of the plurality of elevator devices and each of the plurality of illumination devices; and wherein a dynamic three-dimensional object is formed using all of the LEDs by repeating an operation that the up-down motion control means of the elevator device operates the motor to operate the reel and the illumination control means of the illumination device operates the LED, in relation to each of the plurality of elevator devices and each of the a plurality the plurality of illumination devices.

According to the present invention, it is possible to dynamically provide the three-dimensional stage representation of an imaginary three-dimensional object.

Further features of the present invention will become apparent from the following description of exemplary embodiments with reference to the attached drawings.

DESCRIPTION OF THE EMBODIMENTS

Embodiments of the present invention will be described below in detail with reference to the attached drawings.

Figure 1:
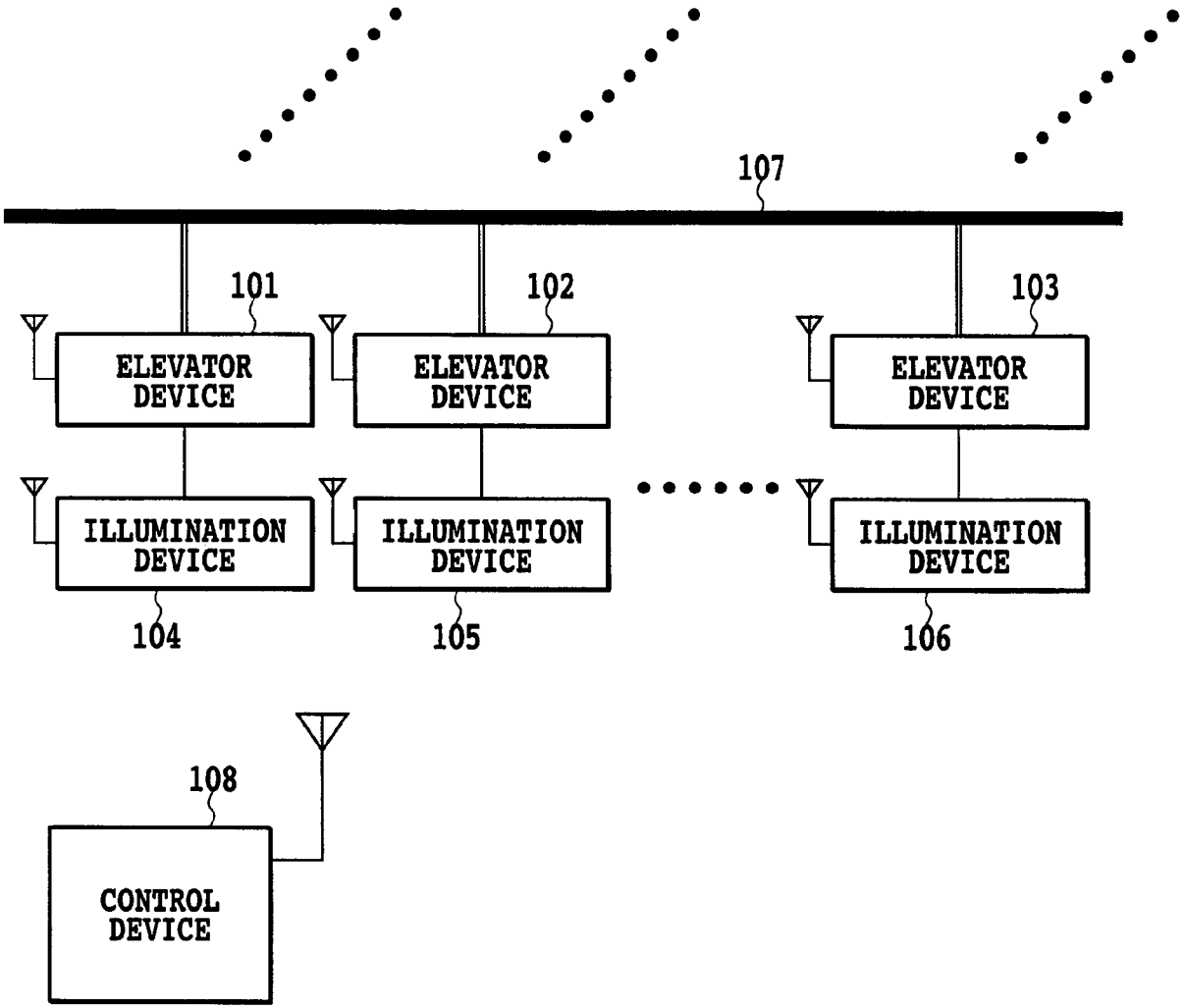
FIG. 1 is a configuration view illustrating a three-dimensional stage representation system according to one embodiment of the present invention.

FIG. 1 illustrates a configuration of a three-dimensional stage representation system according to the present invention. The three-dimensional stage representation system according to this embodiment includes elevator devices 101, 102 and 103 for moving illumination devices up and down, illumination devices 104, 105 and 106 having LEDs and connected to the elevator devices 101, 102 and 103, respectively, by reel wires such as nylon guts, a planar baton 107 for suspending the elevator devices 101, 102 and 104 therefrom, and a control device 108 connected to the elevator devices 101, 102 and 103 and the illumination devices 104, 105 and 106 via wireless means to be capable of operating the elevator devices 101, 102 and 103 and the illumination devices 104, 105 and 106 independently from each other.

The elevator devices 101, 102 and 103, the illumination devices 104, 105 and 106, and the control device 108 have antennas, respectively. The independent one-to-one wireless connection can be accomplished by the respective antenna between the control device 108 and each of the elevator devices 101, 102 and 103 and the illumination devices 104, 105 and 106. For example, by operating the control device 108, it is possible to individually send an indication signal to the elevator device 101 to descend the illumination device 104. Further, by operating the control device 108, it is possible to individually send an indication signal to the illumination device 104 without the intervention of the elevator device 101 to switch on/off an LED.

To switch on/off the LED of the illumination device 104 by operating the control device 108, a method may be possible wherein, instead of establishing the one-to-one connection between the illumination device 104 and the control device 108, the elevator device 101 is connected to the illumination device 104 so that the illumination device 104 is operable by the control device 108 via the elevator device 101. In this method, however, a communication section for the illumination device 104 is necessary in the elevator device 101. Further, if the elevator device 101 and the illumination device 104 are connected by a wired connection, a connection cord or others becomes necessary between the elevator device 101 and the illumination device 104 in addition to the reel wire such as nylon guts.

Accordingly, by comparing a case where the illumination device 104 is operated by the control device 108 via the elevator device 101 with a case where the three-dimensional stage representation system according to this embodiment is used, it is apparent that the latter is advantageous in respect to the miniaturization as well as the weight saving. The three-dimensional stage representation system according to this embodiment is not necessary to use the conventional short pole between the elevator device 101 and the illumination device 104, but may use reel wires such as nylon guts, whereby the displacement distance accompanied with the up-down movement between the elevator device 101 and the illumination device 104 can be prolonged.

In place of the illumination device used in the three-dimensional stage representation system according to this embodiment, acoustic equipment such as a speaker or a set containing large props or stage properties may be adopted so that the three-dimensional stage representation different from that employing the illumination device can be accomplished.

Figure 2:
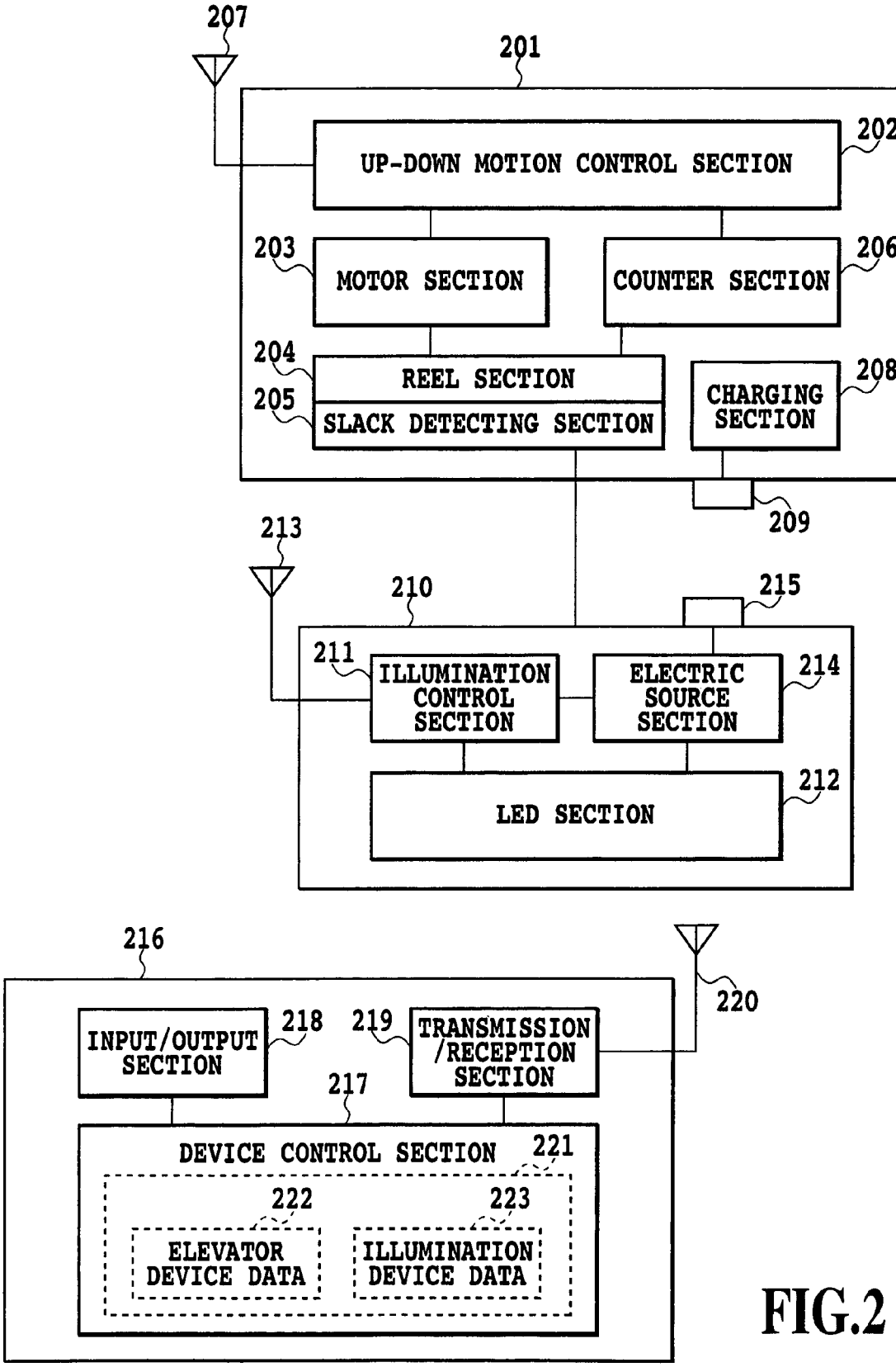
FIG. 2 is a block diagram illustrating the three-dimensional stage representation system according to the embodiment of the present invention.

FIG. 2 is a block diagram illustrating a three-dimensional stage representation system according to one embodiment of the present invention. An elevator device 201 in the three-dimensional stage representation system according to this embodiment includes an up-down motion control section 202 for controlling the respective parts, a motor section 203 connected an input/output part of the up-down motion control section 202 for supplying power thereto, a reel section 204 connected to the motor section 203 for winding/unwinding reel wires such as nylon guts, a slack detecting section 205 connected to the reel section 204 for detecting slack of the reel wires such as nylon guts wound/unwound by the reel section 204, a counter section 206 connected to the input/output part of the up-down motion control section and the output of the reel section 204 for monitoring length of the reel wire such as nylon gut, an antenna section 207 connected to the input/output part of the up-down motion control section 202 for communicating with a control device 216, a charging section 208 for charging an illumination device 210, and a connector section 209 connected to the charging section 208 and detachable/attachable relative to the connector section of the opposed device.

The illumination device 210 of the three-dimensional stage representation system according to this embodiment includes an illumination control section 211 for controlling the respective parts, an LED section 212 connected to the input/output part of the illumination control section 211 and illuminated, an antenna section 213 for communicating with the control device 216, an electric source section 214 for supplying electric power to the illumination control section 211 and the LED section 212, and a connector section 215 connected to the electric source section 214 and detachable/attachable relative to the connector section of the opposed device.

The control device 216 of the three-dimensional stage representation system according to this embodiment includes a device control section 217 for generating indication signals to target devices and, respectively, controlling the elevator device and the illumination device to be operated, an input/output part 218 connected to the input/output part of the device control section 217 for providing a user interface, a transmission/reception section 219 for transmitting/receiving signals relative to/from the elevator device and the illumination device to be operated, and an antenna section 220 connected to the input/output part of the transmission/reception section 219 for communicating with the elevator device and the illumination device to be operated. The device control section 217 has a memory 221 for storing data. The memory 221 stores elevator device data 222 containing data of the respective elevator devices, and illumination device data 223 containing data of the respective illumination devices.

According to such a configuration, the three-dimensional stage representation system is provided, wherein a plurality of illumination devices are independently movable up and down to exhibit the three-dimensional stage representation. Then, after describing a processing of each device in the three-dimensional stage representation system, operations of the elevator device and the illumination device in the three-dimensional stage representation system according to this embodiment will be explained when operations of the elevator device and the illumination device have been preliminarily programmed.

Figure 3:
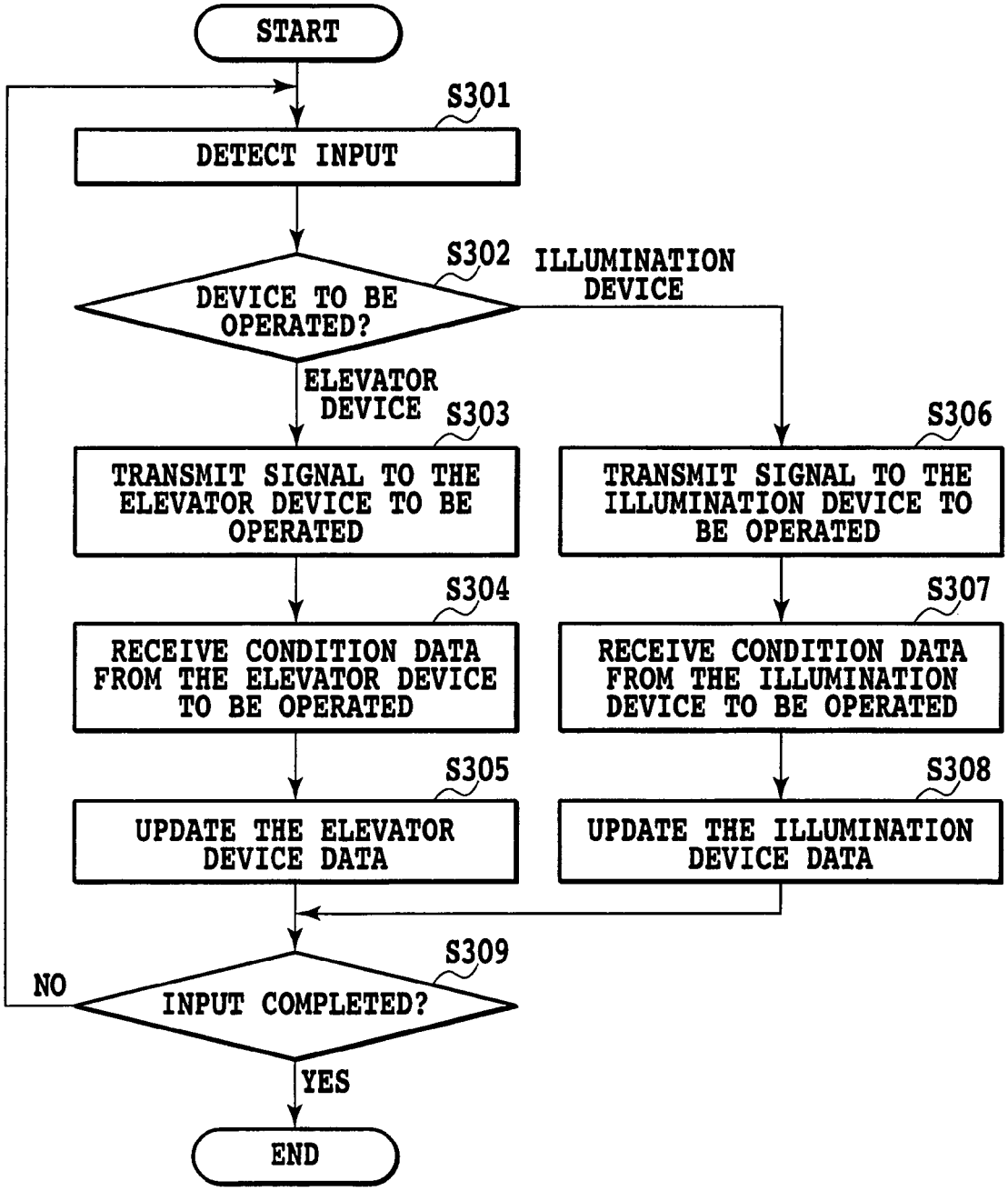
FIG. 3 is a flow chart illustrating a method relating to a processing performed by a control device in the three-dimensional stage representation system according to the embodiment of the present invention.

FIG. 3 is a flowchart illustrating a method relating to a processing of the control device of the three-dimensional stage representation system according to this embodiment of the present invention. If the control device is input from external such as an operator, the input is detected by the input/output part of the control device at S301. At S302, the device control section of the control device identifies a device to be operated from the input detected by the input/output part of control device, and generates an indication signal to the device to be operated. If the device to be operated identified at S302 is the elevator device, the method proceeds to S303.

For example, it is assumed that the illumination device is moved down by lowering the reel wire due to the input from the external such as the operator so that length L of the connected reel wire from the elevator device to the illumination device coupled to each other is "3 m". Then, at S303, the device control section of the control device generates an indication signal representing "L=3 m" from the input detected by the input/output part of the control device, and transmits a signal to a transmission/reception section of the control device, for informing that the indication signal thus generated is transmitted to the elevator device to be operated. The transmission/reception section of the control device receiving the signal transmitted from the device control section of the control device transmits the indication signal representing "L=3 m" to the elevator device to be operated via the antenna section of the control device in accordance with the received signal.

The elevator device to be operated receiving the indication signal transmitted from the transmission/reception section of the control device performs an operation for descending the illumination device while the length L of the reel wire connecting the illumination device to the elevator device becomes "3 m" since the content of the received indication signal is "L=3 m". The operation of the elevator device to be operated will be described below with reference to FIG. 4. Further, it is assumed that the illumination device normally moves down, for example, by an operation of the elevator device to be operated.

Then, condition data is transmitted to the control device by the elevator device to be operated, showing that the lowering of the illumination device has been completed by the elevator device to be operated while defining the length L of the reel wire from the elevator device to the illumination device coupled to each other at "3 m". At S304, the transmission/reception section of the control device receives the condition data transmitted from the elevator device to be operated via the antenna section of the control device. At S305, the device control section of the control device stores the condition data received by the transmission/reception section of the control device in the memory and updates the elevator device data stored in the memory.

In addition, the device control section of the control device transmits an output signal indicating that the operation of the elevator device to be operated has been completed and "L=3 m" to the input/output part of the control device. The input/output part of the control device receiving the output signal transmitted from the device control section outputs information showing the operation-completed state of the elevator device to be operated as well as "L=3 m" to the external such as the operator. While the operator inputs that the length L of the reel wire from the elevator device to the illumination device connected to each other in this example, the indication for moving the illumination device up and down may be input as length of the reel wire for moving the illumination device up and down.

If the device to be operated identified at S302 is the illumination device, the method proceeds to S306. For example, it is assumed that the LED is lit at a predetermined brightness by an input from the external such as the operator. Then, at S306, the device control section of the control device generates an indication signal for indicating that the LED is lit in a color having the predetermined brightness (for example, represented by RGB or HSL) by the input detected by the input/output section of the control device, and transmits a signal for transmitting the generated indication signal to the illumination device to be operated to the transmission/reception section of the control device. The transmission/reception section of the control device receiving the signal transmitted from the device control section of the control device transmits the indication signal to the illumination device to be operated via the antenna section of the control device in accordance with the received signal.

The illumination device to be operated receiving the indication signal transmitted from the transmission/reception section of the control device performs an operation for lighting the LED since the content of the received indication signal commands the lighting of the LED. The operation of the illumination device to be operated will be described below with reference to FIG. 5. Further, it is assumed, for example, that the LED normally lit by the operation of the illumination device to be operated.

Then, condition data representing that the operation for lighting the LED has been completed in the illumination device to be operated is transmitted to the control device. At S307, the transmission/reception section of the control device receives the condition data transmitted from the illumination device to be operated via the antenna section of the control device. At S308, the device control section of the control device stores the condition data received by the transmission/reception section of the control device in the memory and updates the illumination device data stored in the memory.

Further, the device control section of the control device transmits an output signal representing the operation-completion condition and the LED-lighting condition of the illumination device to be operated to the input/output part of the control device in accordance with the condition data stored in the memory. The input/output part of the control device receiving the output signal transmitted from the device control section outputs information representing the operation-completion condition of the illumination device to be operated as well as the LED-lighting condition to the external such as the operator.

Figure 4:
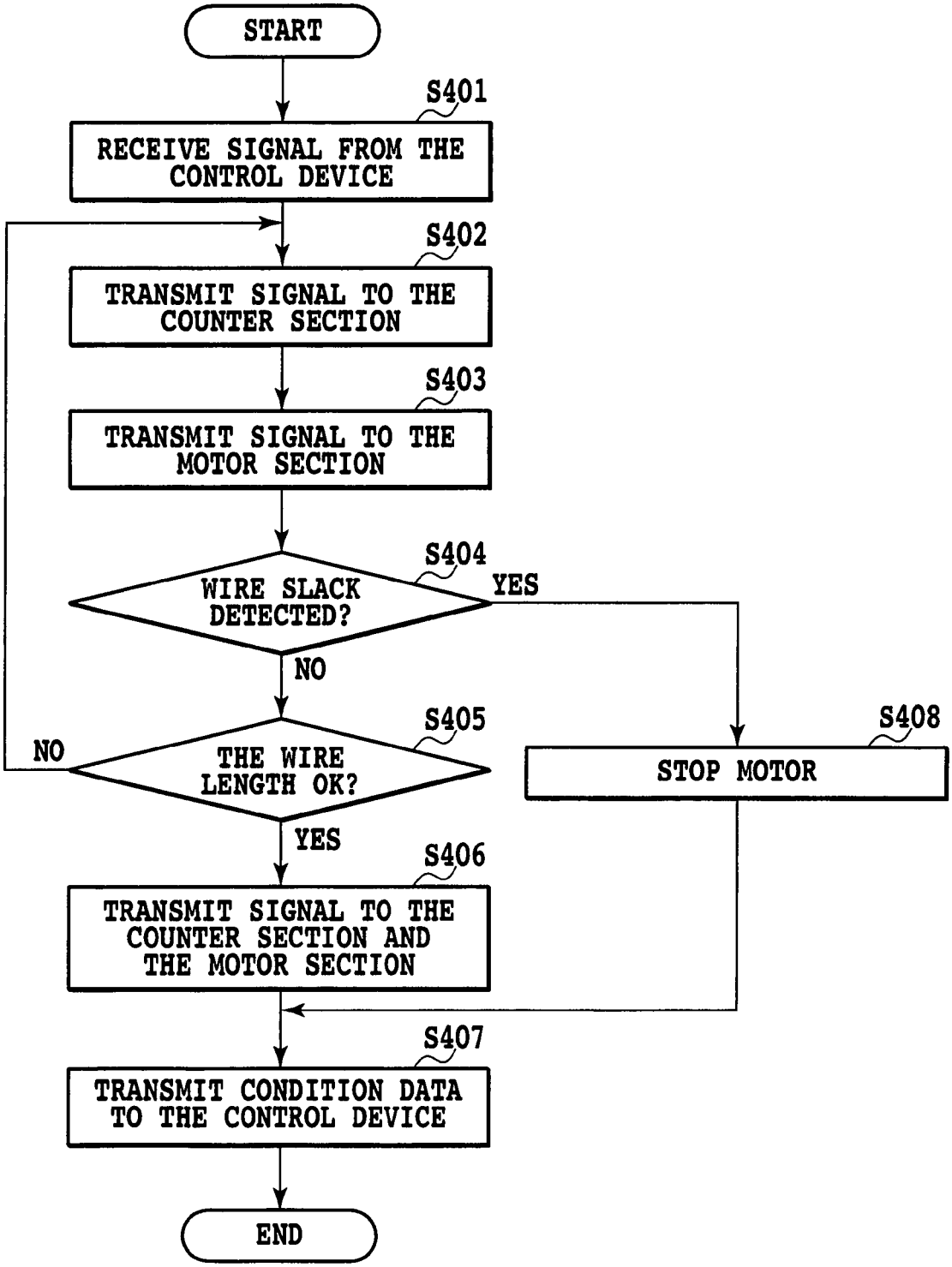
FIG. 4 is a flow chart illustrating a method relating to a processing performed by an elevator device in the three-dimensional stage representation system according to the embodiment of the present invention.

FIG. 4 is a flow chart representing a method relating to a processing of the elevator device in the three-dimensional stage representation system according to this embodiment of the present invention. When an indication signal is transmitted from the control device in the three-dimensional stage representation system according to this embodiment to the elevator device to be operated, the up-down motion control section of the elevator device receives the indication signal from the control device via the antenna section of the elevator device at S401. For example, it is assumed that the content of the indication signal received from the control device is to lower the illumination device by descending the reel wire so that the length of the reel wire from the elevator device to the illumination device connected thereto becomes "3 m". Then, at S402, the up-down motion control section of the elevator device receiving the indication signal from the control device transmits a signal that the length of the reel wire to be monitored is "3 m" to the counter section of the elevator device in accordance with the indication signal received from the control device. The counter section of the elevator device receiving the signal from the up-down motion control section of the elevator device starts a monitoring operation whether or not the length of the reel wire is "3 m" in accordance with the signal received from the up-down motion control section of the elevator device.

At S403, the up-down motion control section of the elevator device transmits a signal that a power is supplied to the reel section to the motor section of the elevator device in accordance with the signal received from the control device. The motor section of the elevator device receiving the signal from the up-down motion control section of the elevator device starts an operation for supplying the power to the reel section in accordance with the signal received from the up-down motion control section of the elevator device. When the motor section of the elevator device has started the power supply to the reel section, the reel section of the elevator device starts a reel-out operation of the reel wire, and the slack detecting section of the elevator device starts a detection of slack of the reel wire. Next, at S404, the up-down motion control section of the elevator device determines whether or not the slack detecting section of the elevator device detects the slack of the reel wire reeled out from the reel section of the elevator device.

If the slack of the reel wire reeled out from the reel section of the elevator device is not detected at S404, the method proceeds to S405. At S405, the up-down motion control section of the elevator device determines whether or not the length of the reel wire monitored by the counter section of the elevator device is "3 m". If the length of the reel wire monitored by the counter section of the elevator device is "3 m" at S405, the method proceeds to S406.

At S406, the up-down motion control section of the elevator device transmits signals for finishing operations of the counter section and the motor section of the elevator device, respectively, to the counter section and the motor section of the elevator device. The counter section and the motor section of the elevator device receiving the signals for finishing the operations thereof finish the operations, respectively. When the operation of the motor section of the elevator device is completed, the operations of the reel section and the slack detecting section of the elevator device are completed, respectively. Then, at S407, the up-down motion control section of the elevator device transmits, via the antenna section of the elevator device to the control device, condition data of the elevator device representing that the operation for descending the illumination device has been completed while defining the length L of the reel wire from the elevator device to the illumination device at "3 m".

If the slack detecting section of the elevator device detects the slack of the reel wire reeled out from the reel section of the elevator device at 404, for example, when the descending illumination device is brought into contact with a barrier, the method proceeds to S408. At S408, the up-down motion control section of the elevator device disrupts an operation of the motor section of the operating elevator device to stop the operations of the reel section and the slack detecting section of the operating elevator device, respectively. Next, the method proceeds to S407 at which the up-down motion control section of the elevator device transmits, via the antenna section of the elevator device to the control device, condition data of the elevator device representing that the reel section of the elevator device is abnormally made to stop. Also, if the length of the reel wire monitored by the counter section of the elevator device is not "3 m" at S405, the method goes back to S402 and the method is continued. While the indication signal represents that the length of the reel wire from the elevator device to the illumination device coupled to each other is "3 m" in this example, the indication signal may represent length of the reel wire along which the illumination device is moved up or down in another example.

In the method regarding the processing of the elevator device according to this embodiment, if the slack generates in the reel wire, the operation of the motor section of the elevator device is made to stop by the up-down motion control section of the elevator device so that the operations of the reel section and the slack detecting section are interrupted, respectively. However, upon the generation of slack, in place of being controlled by the up-down motion control section of the elevator device, the power supplied from the motor section may be cut off from the reel section by a mechanism of the reel section itself to stop the operations of the reel section and the slack detecting section of the elevator device, respectively.

Figure 5:
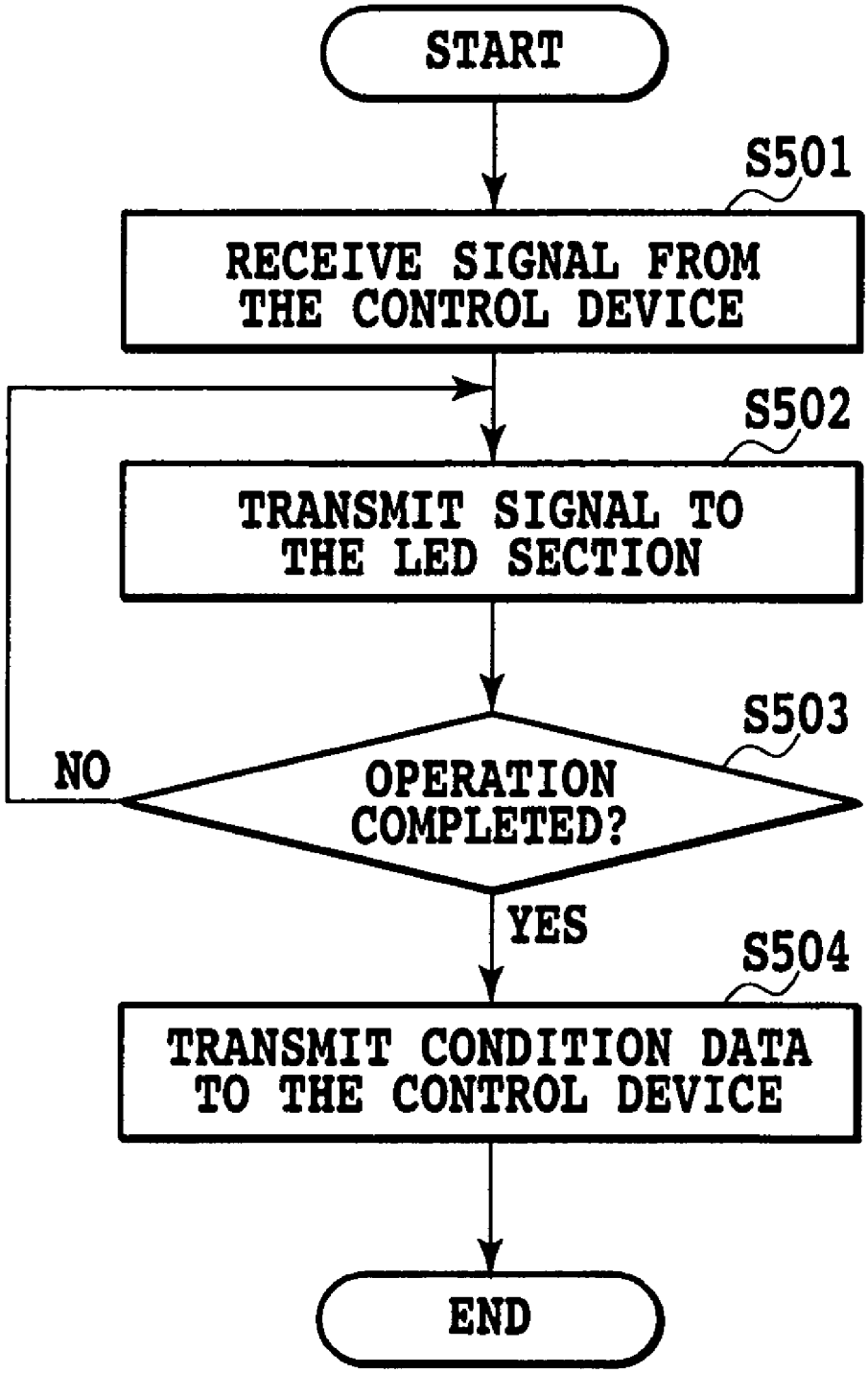
FIG. 5 is a flow chart illustrating a method relating to a processing performed by an illumination device in the three-dimensional stage representation system according to the embodiment of the present invention.

FIG. 5 is a flow chart illustrating a method relating to a processing of the illumination device in the three-dimensional stage representation system according to this embodiment of the present invention. When an indication signal is transmitted to the illumination device to be operated from the control device of the three-dimensional stage representation system according to this embodiment, the illumination control section of the illumination device receives the indication signal from the control device via the antenna section of the illumination device at S501. For example, it is assumed that the content of the indication signal from the control device is that the LED is made to light in a color of a predetermined brightness (for example, represented by RGB or HLS). Then, at S502, the illumination control section of the illumination device receiving the indication signal from the control device transmits a signal to the LED section of the illumination device in accordance with the indication signal received from the control device, so that the LED should be lit in the color having the predetermined brightness. The LED section receiving the signal from the illumination control section of the illumination device starts an operation for lighting the LED in the color having the predetermined brightness in accordance with the signal received from the illumination control section of the illumination device.

Next, at S503, the illumination control section of the illumination device determines whether or not the LED section of the illumination device has completed the operation for lighting the LED. If the LED section of the illumination device has completed the operation for lighting the LED, the method proceeds to S504. At S504, the illumination control section of the illumination device transmits condition data of the illumination device to the control device via the antenna section of the illumination device, representing the completion of the operation for lighting the LED of the illumination device. On the contrary, if the LED section of the illumination device has not completed the operation for lighting the LED at S503, the method goes back to S502 and the method is continued.

Figure 6:
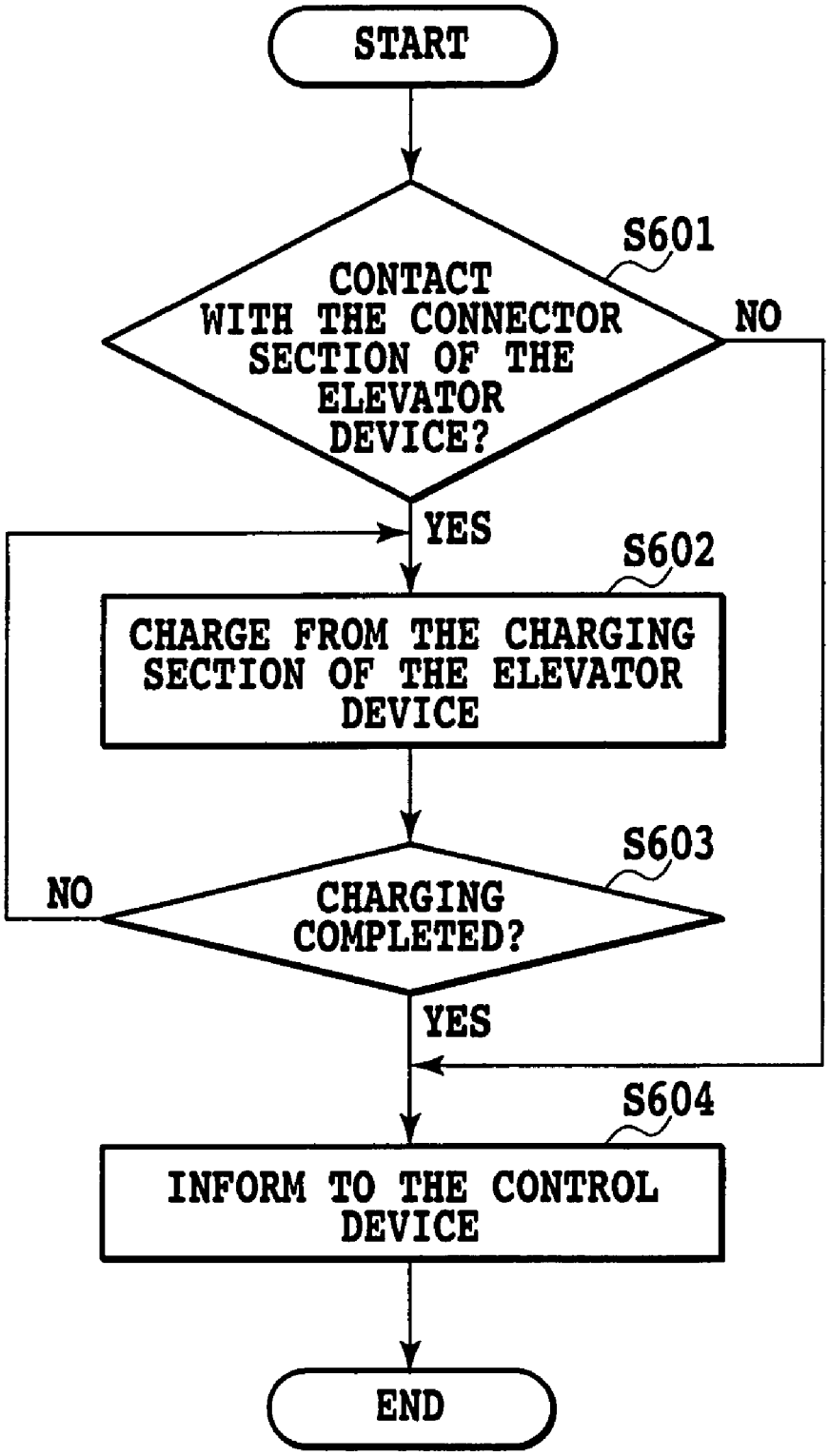
FIG. 6 is a flow chart illustrating a method for charging an electric source for the illumination device in the three-dimensional stage representation system according to the embodiment of the present invention.

FIG. 6 is a flow chart illustrating a method for charging the electric source section of the illumination device in the three-dimensional stage representation system according to this embodiment of the present invention. When the reel wire is wound up by the reel section of the elevator device in the three-dimensional stage representation system according to the present invention, the illumination control section of the illumination device determines whether or not the connector section of the illumination device is brought into contact with the connector section of the elevator device at S601. If it is determined at S601 that the connector section of the illumination device is in contact with the connector section of the elevator device, the method proceeds to S602.

Then, at S602, the illumination control section of the illumination device causes the charging section of the elevator device to start a charging operation for the electric source section of the illumination device. Next, at S603, the illumination control section of the illumination device determines whether or not the charging of the electric source section in the illumination device has been completed. If the answer is affirmative at S603, the method proceeds to S604. At S604, the illumination control section of the illumination device transmits condition data representing the completion of the charging in the electric source section of the illumination device to the control device via the antenna section of the illumination device.

If the answer is negative at S601, the method proceeds to S604. At S604, the illumination control section of the illumination device transmits condition data of the illumination device representing that the charging of the electric source section in the illumination device has not started, to the control device via the antenna section of the illumination device. If the answer is negative at S603, the method goes back to S602 and the method is continued.

In the method regarding the charging of the electric source section of the illumination device in this embodiment, if the connector section of the illumination device is in contact with that of the elevator device, the charging of the electric source section of the illumination device is started by the illumination control section of the illumination device. However, it may be possible to start the charging of the electric source section of the illumination device through the charging section of the elevator device by a mechanism of the electric source section of the illumination device itself.

Next, a concrete example of this embodiment according to the present invention will be described with reference to FIGS. 1 to 6. it is assumed that an operator using the control device 108 brings down the illumination device by the elevator device 101 so that the length of the reel wire becomes "3 m" and lights the LED in a color having a predetermined brightness by the illumination device 104. First, the operator inputs a command into the control device 108 so that the elevator device 101 causes the illumination device 104 to move downward by unwinding the reel wire until the length L of the reel wire from the elevator device 101 to the illumination device 104 coupled to each other becomes "3 m".

Then, the input/output part 218 of the control device 108 detects the input from the operator (S301). The device control section 217 of the control device 108 identifies a device to be operated by the detected input (S302). Since the identified device to be operated is the elevator device 101, the device control section 217 of the control device 108 transmits an indication signal representing "L=3 m" to the elevator device 101 via the transmission/reception section 219 and the antenna section 220 of the control device 108 (S303).

Then, the up-down motion control section 202 of the elevator device 101 receives the indication signal from the control device 108 via the antenna section 207 of the elevator device 101 (S401). The up-down motion control section 202 of the elevator device 101 transmits a signal that the length of the reel wire to be monitored is "3 m" to the counter section 206 of the elevator device 101 in accordance with the indication signal received from the control device 108 (S402). The counter section 206 of the elevator device 101 starts monitoring in accordance with the signal received from the up-down motion control section 202 of the elevator device 101 whether or not the length of the reel wire is "3 m".

The up-down motion control section 202 of the elevator device 101 transmits a signal for supplying a power to the reel section 204 to the motor section 203 of the elevator device 101 in accordance with the indication signal received from the control device 108 (S403). The motor section 203 of the elevator device 101 starts the power supply to the reel section 204 in accordance with the signal received from the control device 108. In the elevator device 101, when the motor section 203 supplies the power to the reel section 204, the reel section 204 starts unwinding the reel wire and the slack detecting section 205 starts detecting slack of the reel wire.

When the reel wire is unwound, the up-down motion control section 202 of the elevator device 101 determines whether or not the slack detecting section 205 of the elevator device 101 detects the slack of the reel wire represented in the reel section 204 of the elevator device 101 (S404). If the answer is negative, the up-down motion control section 202 of the elevator device 101 determines whether or not the length of the reel wire monitored by the counter section 206 of the elevator device 101 is equal to "3 m" (S405).

If the length of the reel wire monitored by the counter section 206 of the elevator device 101 is "3 m", the up-down motion control section 202 of the elevator device 101 transmits signals for finishing operations of the counter section 206 and the motor section 203 of the elevator device 101 to the counter section 206 and the motor section 203 of the elevator device 101, respectively (S406). The counter section 206 and the motor section 203 of the elevator device 101 receiving the signals for finishing the operations thereof complete the operations thereof. Further, the up-down motion control section 202 of the elevator device 101 transmits condition data of the elevator device 101 representing that the length L of the reel wire from the elevator device 101 to the illumination device 104 coupled to each other becomes "3 m" and the operation for descending the illumination device has been completed to the control device 108 via the antenna section 207 of the elevator device 101 (S407).

Then, the transmission/reception section 219 of the control device 108 receives the condition data transmitted from the elevator device 101, via the antenna section 220 of the control device 108 (S304). The device control section 217 of the control device 108 stores the condition data received by the transmission/reception section 219 of the control device 108 in the memory 221 and updates the elevator device data 222 stored in the memory 221 (S305).

Furthermore, the device control section 217 of the control device 108 outputs information to the input/output part 218 of the control device 108, that the operation of the elevator device 101 has completed and the length L of the reel wire from the elevator device 101 to the illumination device 104 coupled to each other is "3 m" in accordance with the condition data stored in the memory 221. The operator recognizes by the output of the condition of the elevator device 101 that the illumination device 104 moves down whereby the length L of the reel wire from the elevator device 101 to the illumination device 104 coupled to each other becomes "3 m".

Secondly, in the control device 108, the operator inputs a command that the LED of the illumination device 104 should be lit in a color having the predetermined brightness.

Then, the input/output part 218 of the control device 108 detects the input from the operator (S301). The device control section 217 of the control device 108 identifies a device to be operated by the detected input (S302). Since the identified device to be operated is the illumination device 104, the device control section 217 of the control device 108 transmits an indication signal to the illumination device 104 via the transmission/reception section 219 and the antenna section 220 of the control device 108, representing that the LED of the illumination device 104 should be lit in a color having the predetermined brightness (for example, represented by RGB or HLS) (S306).

Next, the illumination control section 211 of the illumination device 104 receives the indication signal from the control device 108 via the antenna section 213 of the illumination device 104 (S501). The illumination control section 211 of the illumination device 104 transmits a signal to the LED section 212 of the illumination device 104 in accordance with the indication signal received from the control device 108, representing that the LED should be lit in a color having the predetermined brightness (for example, represented by RGB or HLS) (S502). The LED section 212 of the illumination device 104 begins to light the LED in a color having the predetermined brightness in accordance with the signal received from the illumination control section 211 of the illumination device 104.

The illumination control section 211 of the illumination device 104 determines whether or not the LED section 212 of the illumination device 104 has completed the operation for lighting the LED (S503). If the answer is affirmative, the illumination control section 211 of the illumination device 104 transmits condition data of the illumination device 104 to the control device 108 via the antenna section 213 of the illumination device 104, representing that the operation for lighting the LED of the illumination device 104 has been completed (S504).

Then, the transmission/reception section 219 of the control device 108 receives, via the antenna section 220 of the control device 108, the condition data transmitted from the illumination device 104 (S307). The device control section 217 of the control device 108 stores the condition data received by the transmission/reception section 219 of the control device 108 in the memory 221 and updates the illumination device data 223 stored in the memory 221 (S308).

The device control section 217 of the control device 108 causes the input/output part 218 of the control device 108 to output information representing the completion of the operation of the illumination device 104 and the LED lighting condition of the illumination device 104 in accordance with the condition data stored in the memory 221. The operator recognizes that the LED of the illumination device 104 has been lit by the output of the condition of the illumination device 104.

In the above-mentioned description in relation to this embodiment according to the present invention, a concrete example is shown wherein the control device 108 is used for descending the illumination device 104 by the elevator device 101 to make the length L of the reel wire from the elevator device to the illumination device coupled to each other to be "3 m", after which the LED is lit by the illumination device 104. However, since the operation of the control device 108 on the elevator device 101 and the operation of the control device 108 on the illumination device 104 are independent from each other, it is possible either to descend the illumination device 104 by the elevator device 101 after the LED is turned on by the illumination device 104 to define the length L of the reel wire from the elevator device to the illumination device coupled to each other at "3 m", or descend or elevate the illumination device 104 by the elevator device 101 simultaneously with turning the LED on/off by the illumination device 104.

According to this embodiment, it is possible to provide a method and a system for representing an imaginary three-dimensional object by repeatedly descending and elevating a plurality of illumination devices independent from each other so that the three-dimensional stage representation can be accomplished.

In the above-mentioned description relating to this embodiment of the present invention, an operator operates the control device to independently descend or elevate a plurality of illumination devices. However, it may be possible to autonomously descend or elevate the plurality of illumination devices independently from each other, or to turn on/off the plurality of LEDs independently from each other by the device control section of the control device without the intervention of the operator if the operation for elevating or descending the illumination devices by the elevator device and the operation for turning on/off the LED of the illumination device are preliminarily programmed in the device control section of the control device in the three-dimensional stage representation system. By such the preliminary programming in the device control section of the control device, it is possible to form an imaginary object on a stage, for example, when viewing from audience seats in a theater or others. For instance, an arch type gate is supposed as an imaginary object on the stage. If LEDs are arranged on a line corresponding to a contour of the gate, the object could be formed by the aggregation of discrete points. The operation of the three-dimensional stage representation system for forming the imaginary object by the preliminary programming of actions of the elevator devices and the illumination devices will be described below with reference to FIGS. 7A and B.

Figure 7A:
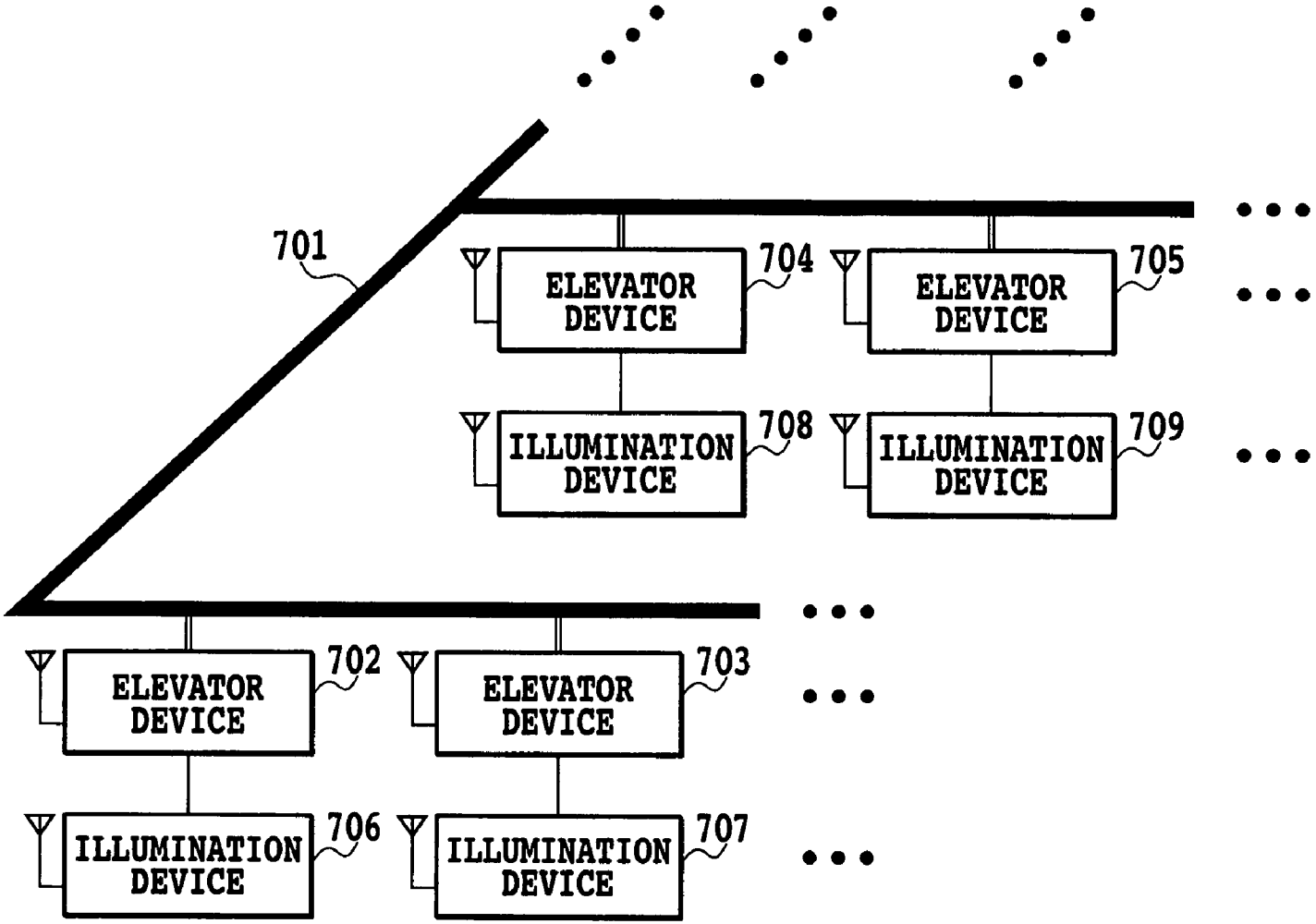
FIGS. 7A and 7B is a configuration view illustrating an example of the three-dimensional stage representation system according to one embodiment of the present invention.

FIGS. 7A and B is a configuration view illustrating an example of the three-dimensional stage representation system for displaying an imaginary object according to one embodiment of the present invention. A concrete example of the three-dimensional stage representation system according to this embodiment includes a planar baton 701 for suspending devices, elevator devices 702 to 705 for moving illumination devices up and down, illumination devices 706 to 709 having LEDs, respectively, and coupled to the elevator devices 702 to 705 by reel wires such as nylon guts, and an control device 710 wirelessly coupled to the elevator devices 702 to 705 and the illumination devices 706 to 709 and programmed to be capable of independently operating the elevator devices 702 to 705 and the illumination devices 706 to 709. The control device 710 includes a device control section 711. The device control section 711 stores program data 712.

The program data 712 stored in the device control section 711 has information on the respective LEDs of the illumination devices 706 to 709 variable with time in relation to length L of the reel wire from the elevator device to the illumination device coupled to each other as well as brightness. Here, the information on the length L corresponds to a height of a contour line of an imaginary object (such as an arch type gate) on a stage. The information on the brightness of the LED relates to the on-off operation or brightness/darkness in color. The brightness/darkness in color can be represented by using RGB or HLS.

For instance, the LED 1 of the illumination device 706 has "L=3 m" and is turned on at time 1. Similarly, at time 2, it has "L=2 m" and is dark in color; at time 3, it has "L=1 m" and is bright in color; and at time 4, it has "L=1 m" and is turned off. Here, it is assumed that the brightness of LED becomes brighter in the order of dark, turned-on and bright.

The LED 2 of the illumination device 707 has "L=2 m" and is turned off at time 1. At time 2, it has "L=3 m" and is turned on; at time 3, it has "L=2 m" and is bright in color; and at time 4, it has "L=1 m" and is turned off. The LED 3 of the illumination device 708 has "L=2 m" and is turned on at time 1. At time 2, it has "L=1 m" and is dark in color; at time 3, it has "L=3 m" and is bright in color; and at time 4, it has "L=1 m" and is turned off. The LED 4 of the illumination device 709 has "L=1 m" and is turned off at time 1; it has "L=2 m" and is turned on at time 2; it has "L=2 m" and bright in color at time 3; and it has "L=1 m" and is turned off at time 4.

Similarly, the program data 712 stored in the device control section 711 has the information on the respective LEDs in all the illumination devices variable with time regarding the length L of the reel wire from the elevator device to the illumination device coupled to each other as well as the brightness in color all over the period in which the stage representation is performed.

By such a program, it is possible to form an imaginary object (for example, an arch type gate) on the stage. Also, by controlling the light emission of the LED, it is possible to vary the illumination, for example, in accordance with the motion of a player passing through the gate.

Here, while the program data 712 has the information on the time, the length L of the reel wire from the elevator device to the illumination device coupled to each other and the color brightness, since all the elevator devices used in this embodiment move the illumination devices at the same speed, there may be a case where motion of a certain illumination device delays at a predetermined time whereby it does not reaches the aimed position. Accordingly, in the three-dimensional stage representation system according to this embodiment, the illumination device is controlled by using the length L of the reel wire from the elevator device to the illumination device coupled to each other as a main parameter, while using the time as a secondary parameter.

That is, the control device receives condition data representing the completion of the operation of the elevator device from the elevator device and stores the condition data in the memory shown in FIG. 2 (not shown in FIG. 7B), and thereafter, transmits an indication signal to the elevator device so that the next length L of the reel wire is obtained and then transmits an indication signal to the illumination device.

In this regard, after receiving the condition data representing the completion of the operation of the elevator device from the elevator device and storing the condition data in the memory shown in FIG. 2 (not shown in FIG. 7B), the control device first transmits the indication signal to the elevator device and then to the illumination device. However, the order of the transmission of the indication signals to the elevator device and the illumination device may be reversed or simultaneous.

If the delay of up-down motion of the illumination device is prevented by changing the up-down motion speed of the respective elevator device, it may be possible to control the illumination device by using the time as a main parameter.

The device control section 711 of the control device 710 in the example of the three-dimensional stage representation system according to this embodiment independently operates the elevator devices 702 to 705 and the illumination devices 706 to 709 in the concrete example of the three-dimensional stage representation system according to this embodiment in accordance with the stored program data 712, in the same manner as the method programmed in relation to the operation of the control device in the three-dimensional stage representation system described above with reference to FIG. 3, based on the information contained in the program data 712 relating to the length L of the respective reel wire and the brightness in color.

Here, at S301 described above with reference to FIG. 3, the device control section of the control device generates an indication signal transmitted to a device to be operated, based on the input from external such as an operator detected by the input/output part of the control device. Contrary to this, the device control section 711 of the control device 710 in the example of the three-dimensional stage representation system according to this embodiment does not generate the indication signal to the device to be operated by the detection of the input from the external such as the operator by means of the input/output part of the control device, but generates the indication signal to the device to be operated in accordance with the stored program data 712. An example in relation to the variation of an imaginary object with time represented by the three-dimensional stage representation system while programming the operations of the elevator devices and the illumination devices in the device control section 711 of the control device 710 will be described below with reference to FIG. 8.

Figure 8:
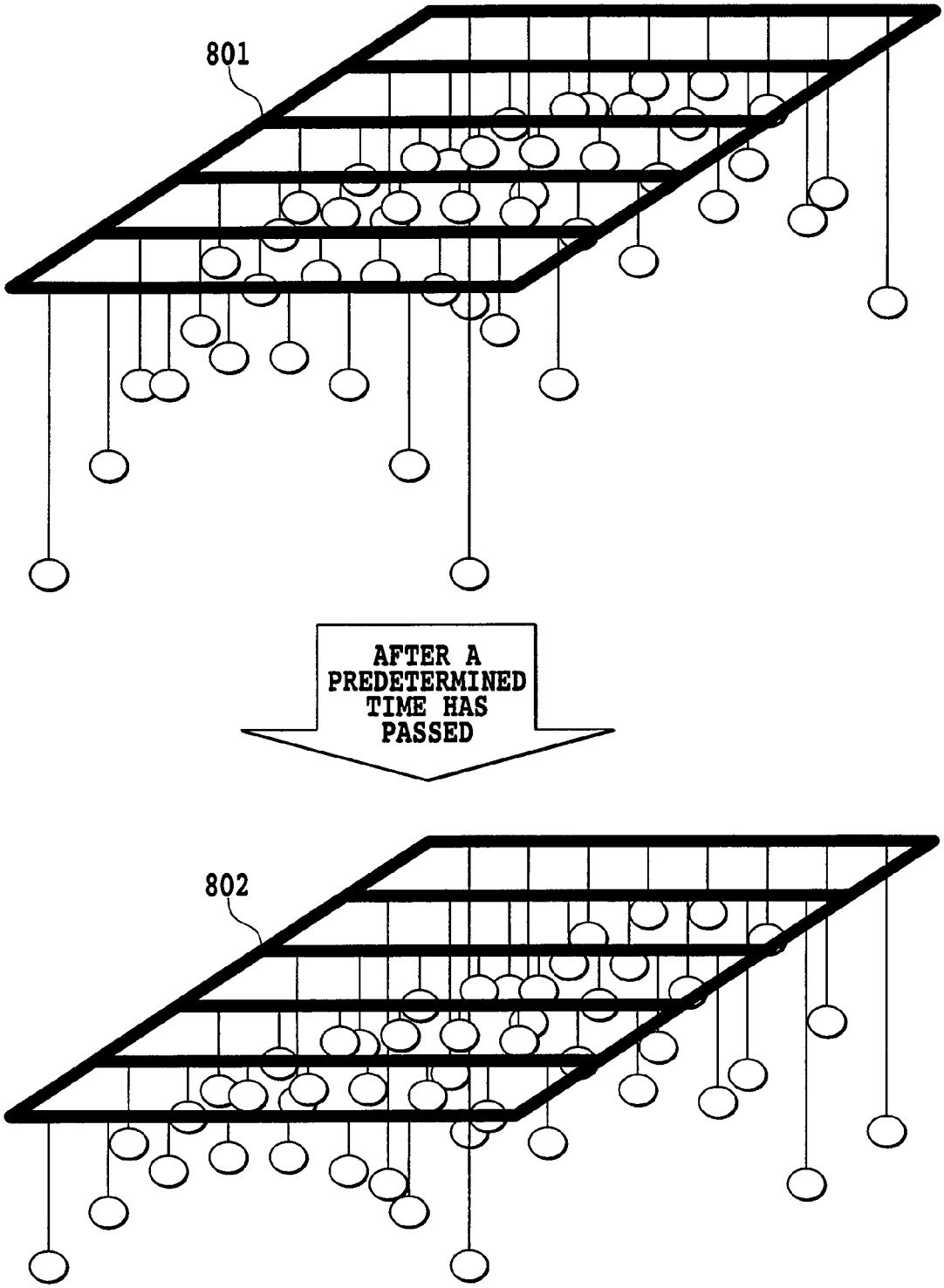
FIG. 8 is a configuration view illustrating an example relating to the change of an imaginary object with time, represented by the three-dimensional stage representation system according to the embodiment of the present invention.

FIG. 8 is a configuration view illustrating an example relating to the change of an imaginary object with time, represented by the three-dimensional stage representation system according to this embodiment of the present invention. In this example, the elevator devices and the control device are not shown for the purpose of simplicity.

For instance, in a state of a planar baton 801, an arch type gates are formed in the depth direction of the stage. On the other hand, in a state of a planar baton 802, the arch type gates are pulled up as a player passes through the gate. It is exceptional that the three-dimensional stage representation system according to this embodiment provides a three-dimensional effect by moving the illumination devices up and down without displacing the planar baton.

Figure 9:
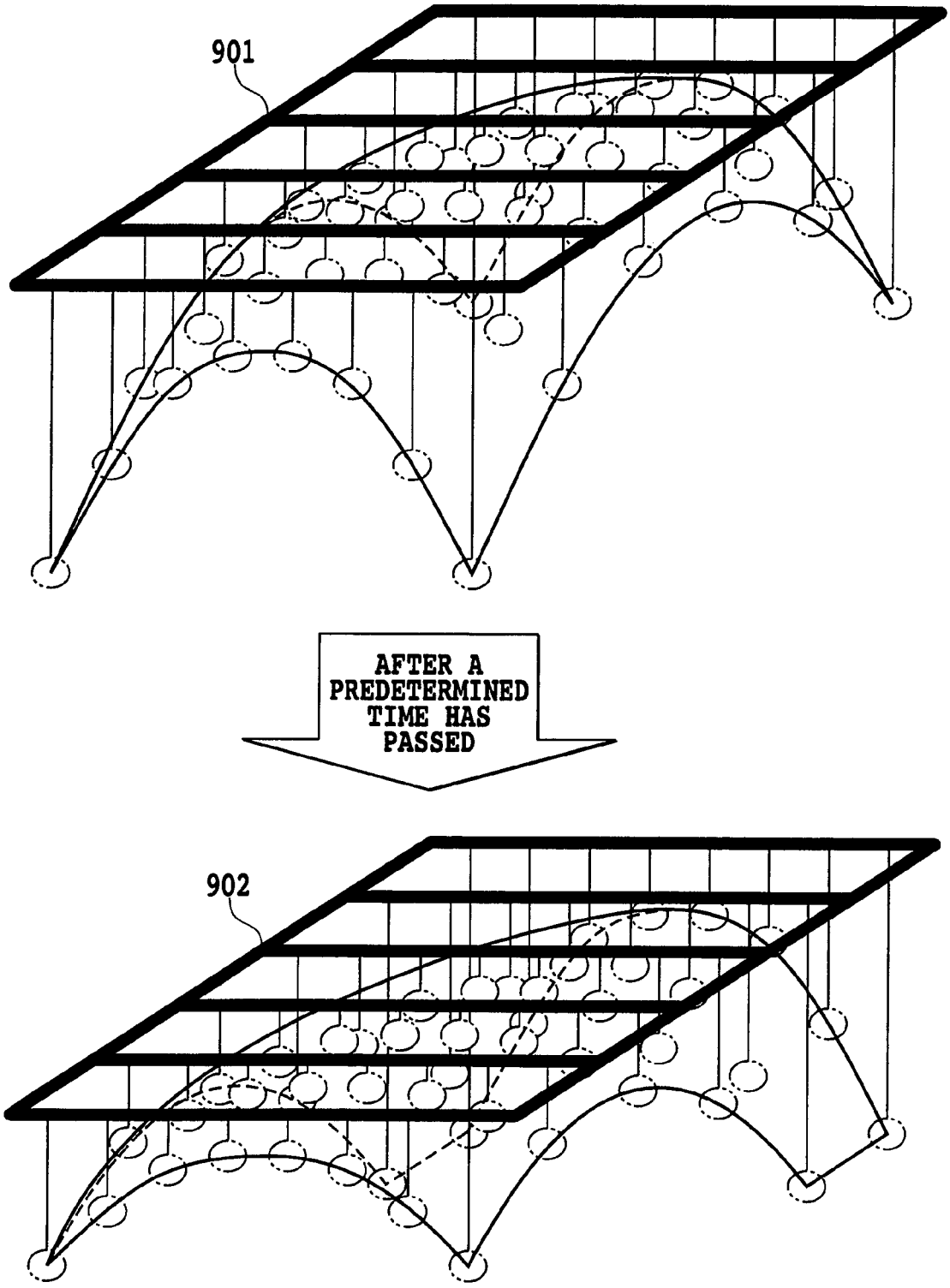
FIG. 9 is a configuration view illustrating another example relating to the change of an imaginary object with time, represented by the three-dimensional stage representation system according to the embodiment of the present invention.

Then, the change of an imaginary object represented by the three-dimensional stage representation system according to this embodiment of the present invention will be described using another example. FIG. 9 is a configuration view illustrating another example relating to the change of an imaginary object with time, represented by the three-dimensional stage representation system according to this embodiment of the present invention. In the same as FIG. 8, also in this example, the elevator devices and the control device are not shown for the purpose of simplicity.

In FIG. 9, a static three-dimensional object representing a levitating magic carpet at two different times according to the three-dimensional stage representation system of this embodiment. For the purpose of the explanation, the contour of outer edge of the carpet is shown by a solid line and the broken line. Based on the program data such as shown in FIG. 7B, the elevator devices and the illumination devices are operated respectively so that the LEDs are arranged on the contour line, whereby the static three-dimensional object of the magic carpet is formed in a state shown in a planar baton 901.

Figure 7B:
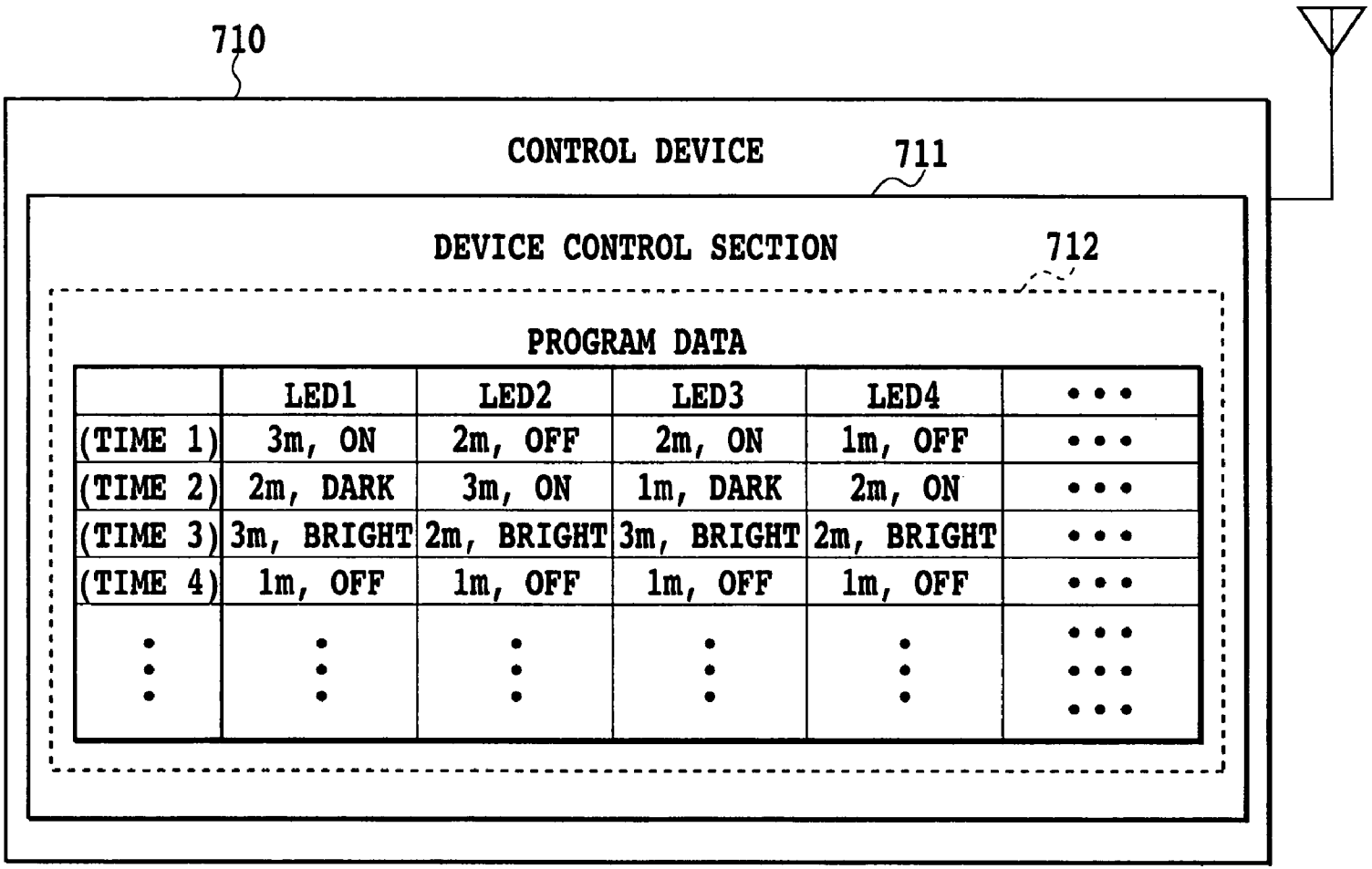

When the control device operates the elevator devices and the illumination devices to arrange the LEDs again on the contour line based on the program data such as shown in FIG. 7B, another static three-dimensional object of the magic carpet is formed in a state shown in a planner baton 902. Thereby, it is possible to move the LEDs corresponding to the edge of the carpet up and down as if the carpet were fluttered by wind. By preliminarily storing the program data as shown in FIG. 7B in the operation control section of the control device, the form of the magic carpet by the three-dimensional stage representation system according to this embodiment is variable with time as if it were levitating in air as seen from any viewing angle, like the representation, for example, by computer graphic.

The magic carpet shown in this example is a mere illustration wherein an imaginary object not actually existing is formed as seen in any viewing angle by using an actual object (such as an animal or landscape) and dynamically variable with time.

Also in this example, the explanation has been made while using the limited number of illumination devices for the simplicity. By narrowing a distance between the adjacent illumination devices and increasing the number thereof, it is possible to represent more exquisite and dynamic three-dimensional object.

According to this embodiment, it is possible to provide a three-dimensional stage representation method and system for forming an imaginary three-dimensional object by moving a plurality of illumination devices up and down independently from each other with time and lighting the LEDs. Since the elevator device, the illumination device and the control device are wirelessly connected to each other, connection cords for the control are unnecessary between the elevator device and the illumination, whereby the reduction in size and weight is possible, and a number of illumination devices are simultaneously movable up and down as well as a number of LEDs are simultaneously turned on/off.

The present invention is applicable not only to the three-dimensional stage representation in a theater, concert hall or TV studio, but also to a case where it is necessary for independently moving up and down a set including a plurality of illumination devices, acoustic equipments such as speakers, large props or stage properties.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A three-dimensional stage representation method used for performing a three-dimensional stage representation with a stage representation system, the stage representation system comprising a control device, a plurality of elevator devices, and a plurality of illumination devices, the control device including a device control means, an input/output means and a transmission/reception means, each of the plurality of elevator devices including an up-down motion control means, a motor and a reel coupled to the motor, each of the plurality of illumination devices including an illumination control means and a light-emitting diode (LED), wherein the number of the elevator devices is the same as the number of the illumination devices and each of the illumination devices is coupled to a corresponding one of the elevator devices by a reel wire, the method comprising the steps of:

(a) by the device control means in the control device, identifying a device to be operated by an input containing information on lengths of the reel wires coupling each of the plurality of elevator devices to the corresponding illumination devices as well as brightnesses of the LEDs and generating an indication signal to the device to be operated;

(b) if the device to be operated identified by the device control means of the control device is the elevator device, by the transmission/reception means of the control device, transmitting the indication signal generated by the device control means of the control device to the elevator device to be operated;

(c) upon the reception of the indication signal transmitted from the transmission/reception means of the control device, by the up-down motion control means of the elevator device, transmitting the content of the received indication signal to the motor of the elevator device to be operated, whereby the motor of the elevator device is operated to move the reel of the elevator device so that the length of the reel wire from the elevator device to the illumination device coupled to each other becomes the input length of the reel wire;

(d) if the device to be operated identified by the device control means of the control device is the illumination device, by the transmission/reception means of the control device transmitting the indication signal generated by the device control means of the control device to the illumination device to be operated;

(e) upon the reception of the indication signal transmitted from the transmission/reception means of the control device, by the illumination control means of the illumination device, transmitting the content of received indication signal to the LED of the illumination device to be operated, whereby the LED is operated based on the input information in relation to the brightness of the LED;

(f) suspending each of the plurality of elevator devices from a planar baton such that a three-dimensional object is formed by using all of the LEDs as a result of performing the steps (c) and (e) on each of the plurality of elevator devices and each of the plurality of illumination devices; and (g) forming a dynamic three-dimensional object by using all of the LEDs as a result of performing the steps (a) to (f) repeatedly.

2. The method according to claim 1, wherein the input is program data having information variable with time on the length of the reel wire from the elevator device to the illumination device coupled to each other and the brightness of the LED in relation to each of the plurality of elevator devices and each of the plurality of illumination devices.

3. A three-dimensional stage representation system used for performing a three-dimensional stage representation, the system comprising:

a plurality of elevator devices, each of the plurality of elevator devices including:

a motor, a reel coupled to the motor, and an up-down motion control means for driving the motor to operate the reel;

a plurality of illumination devices having the same number as the plurality of elevator devices, each of the plurality of illumination devices coupled to a corresponding one of the plurality of elevator devices by a reel wire, and each of the plurality of illumination devices including:

a light-emitting diode (LED), and an illumination control means for operating the LED; and a control device including:

a device control means for identifying a device to be operated by an input containing information on lengths of the reel wires coupling each of the plurality of elevator devices to the corresponding illumination devices as well as brightnesses of the LEDs and generating an indication signal to the device to be operated, and a transmission/reception means for transmitting the indication signal generated by the device control means to the device to be operated if the device to be operated identified by the device control means is the elevator device or the illumination device;

wherein the up-down motion control means of the elevator device receives the indication signal transmitted from the transmission/reception means of the control device and transmits the content of the received indication signal to the motor to operate the reel so that the length of the reel wire from the elevator device to the illumination device coupled to each other becomes the input length of the reel wire;

wherein the illumination control means of the illumination device receives the indication signal transmitted from the transmission/reception means of the control device and transmits the content of the received indication signal to the LED to operate the LED of the illumination device based on the input information in relation to the brightness of the LED;

wherein the three-dimensional stage representation system further comprises a baton for suspending each of the plurality of devices therefrom such that a three-dimensional object is formed by using all of the LEDs resulting from operating the motor to operate the reel by the up-down motion control means of the elevator device and operating the LED by the illumination control means of the illumination device, in relation to each of the plurality of elevator devices and each of the plurality of illumination devices; and a dynamic three-dimensional object is formed by using all of the LEDs by repeating an operation that the up-down motion control means of the elevator device operates the motor to operate the reel and the illumination control means of the illumination device operates the LED, in relation to each of the plurality of elevator devices and each of the plurality of illumination devices.

4. The system according to claim 3, wherein the input is program data having information variable with time on the length of the reel wire from the elevator device to the illumination device coupled to each other and the brightness of the LED in relation to each of the plurality of elevator devices and each of the plurality of illumination devices.

* * * * *